US011731150B2

(12) United States Patent
Lee

(10) Patent No.: US 11,731,150 B2
(45) Date of Patent: Aug. 22, 2023

(54) TUBELESS DISPENSER CONTAINER

(71) Applicant: SAMHWA CO., LTD, Uiwang-si (KR)

(72) Inventor: Kyungchang Lee, Uiwang-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 0 days.

(21) Appl. No.: 17/834,854

(22) Filed: Jun. 7, 2022

(65) Prior Publication Data

US 2023/0115060 A1 Apr. 13, 2023

(30) Foreign Application Priority Data

Oct. 8, 2021 (KR) ..... 10-2021-0134340

(51) Int. Cl.

| | |
|---|---|
| ***B05B 11/00*** | (2023.01) |
| ***B05B 11/10*** | (2023.01) |
| ***A45D 34/00*** | (2006.01) |
| ***A45D 40/00*** | (2006.01) |

(52) U.S. Cl.

CPC ..... *B05B 11/1046* (2023.01); *A45D 34/00* (2013.01); *A45D 40/00* (2013.01); *B05B 11/1098* (2023.01); *A45D 2200/056* (2013.01)

(58) Field of Classification Search

CPC ..... B05B 11/0038; B05B 11/1046; B05B 11/1098; A45D 34/00; A45D 40/00; A45D 2200/056

See application file for complete search history.

(56) References Cited

U.S. PATENT DOCUMENTS 4,793,527 A * 12/1988 Di Stefano ..... F25D 3/10 222/518
2015/0090739 A1* 4/2015 Jung ..... B05B 11/1074 222/256
2022/0348396 A1* 11/2022 Hennemann ..... B65D 83/0072

* cited by examiner

*Primary Examiner* — Vishal Pancholi
*Assistant Examiner* — Robert K Nichols, II
(74) *Attorney, Agent, or Firm* — Park, Kim & Suh, LLC

(57) ABSTRACT

Disclosed is a tubeless dispenser container. A tubeless dispenser container according to one aspect of the invention is a tubeless dispenser container for dispensing a content held in a filling space and includes: a bottle part in which the filling space is formed and which has a supply hole, for allowing a flow of the content, and an air hole, for allowing an inflow of air, formed in its upper surface; a connector part coupled to an upper portion of the bottle part to spatially separate the supply hole from the air hole; and a pump part that is secured to a designated position of the connector part and configured to suction and dispense the content supplied through the supply hole, where a supply channel connecting a lower portion of the filling space with the supply hole may be formed in the bottle part.

7 Claims, 9 Drawing Sheets

TUBELESS DISPENSER CONTAINER

CROSS-REFERENCE TO RELATED APPLICATIONS

This application claims the benefit of Korean Patent Application No. 10-2021-0134340, filed with the Korean Intellectual Property Office on Oct. 8, 2021, the disclosure of which is incorporated herein by reference in its entirety.

BACKGROUND

1. Technical Field

The present invention relates to a dispenser container equipped with a pump, more particularly to a tubeless dispenser container that is capable of dispensing a content in a stable manner without using a plastic tube.

2. Description of the Related Art

In a cosmetic container, etc., that holds a liquid or gel content such as a perfume, etc., a pump may be coupled to an upper opening of the container to dispense a fixed amount of content to the exterior. A user who wishes to dispense a liquid content may press down on a nozzle corresponding to a button, upon which the content that was drawn into the pump may be pressurized, moved up along the discharge path, and subsequently dispensed through the nozzle. When the user removes the pressure on the nozzle, the discharge path may be mechanically closed by the rising of the nozzle, causing a decrease in pressure inside the pump, and the content may again be drawn from the container to compensate for the pressure decrease.

Such a pump is being used for dispensing a variety of contents, including not only perfumes and cosmetics but also air fresheners, insecticides, and others. In particular, the pump is growing in demand due to its convenient use, as a fixed amount of content can be dispensed by a single pressing of the nozzle, and the content is prevented from leaking to the outside.

Generally, in order to dispense a content from a container body holding the content, a pump may be connected to a long plastic tube, with the lower end of the tube touching the bottom surface of the container body. The suctioning force of the pump may be applied on the inside of the tube, allowing the content held in the container body to be drawn in through the tube and into the pump. While such a tube makes it possible to completely use up the content held in the container body, the tube is inserted into the interior of the container body and may be visible from the outside, whereby the overall aesthetic of the container may be lowered. The issue of lowered aesthetic may be especially problematic when the container corresponds to a cosmetic container. In such cases, the container equipped with a pump may often have the container body fabricated from an opaque material, in order that the tube may not be seen from the outside.

SUMMARY OF THE INVENTION

An aspect of the present invention, which was conceived to resolve the problem described above, is to provide a tubeless dispenser container that is capable of dispensing a content in a stable manner without using a plastic tube.

Other objectives of the present invention will be more clearly understood from the embodiments set forth below.

A tubeless dispenser container according to one aspect of the invention is a tubeless dispenser container for dispensing a content held in a filling space and includes: a bottle part in which the filling space is formed and which has a supply hole, for allowing a flow of the content, and an air hole, for allowing an inflow of air, formed in its upper surface; a connector part coupled to an upper portion of the bottle part to spatially separate the supply hole from the air hole; and a pump part that is secured to a designated position of the connector part and configured to suction and dispense the content supplied through the supply hole, where a supply channel connecting a lower portion of the filling space with the supply hole may be formed in the bottle part.

A tubeless dispenser container according to an embodiment of the present invention can include one or more of the following features. For example, the bottle part can include: an inner bottle that has the filling space formed therein, has an open bottom, and has an upper channel connecting with the supply hole formed in an upper portion thereof; and an outer bottle that has an inner diameter greater than the outer diameter of the inner bottle so as to house the inner bottle therein and has a closed bottom, where the upper channel can have one end open towards the outer perimeter of the inner bottle and the other end continuing to the supply hole, and the supply channel can include the upper channel and a space between the inner perimeter of the outer bottle and the outer perimeter of the inner bottle. Here, the inner bottle can include a flange, which may be formed on an upper portion of the inner bottle, and a widened part, which may be formed to a particular height below the flange and which may have an outer diameter corresponding to the inner diameter of the outer bottle so as to tightly contact the inner perimeter of the outer bottle, where an inflow cavity open towards the bottom can be formed in the widened part, and the one end of the upper channel can be formed within the inflow cavity.

The bottle part can include an airduct protrusion, which may protrude upward in a particular length from the upper surface of the bottle part and form a channel therein that connects with the air hole, and the connector part can include an insertion cavity, which may be configured to receive the airduct protrusion as it is force-fitted therein such that the insertion cavity tightly contacts the outer perimeter of the airduct protrusion. While the connector part is coupled to the upper portion of the bottle part, the bottom surface of the connector part can be at least partially separated from the upper surface of the bottle part such that the content flowed out of the supply hole can be supplied to the pump part through a space between the connector part and the bottle part.

In the upper surface of the bottle part, a recessed part can be formed, which may include a filling hole that is open towards the filling space, and the connector part can have a portion thereof inserted in the recessed part to close the filling hole.

The bottle part can include a mounting rim, which may have an annular shape and may protrude upward in a particular length from the upper surface of the bottle part, and the connector part can be configured to have a portion thereof force-fitted into an inner side of the mounting rim so as to tightly contact the inner perimeter of the mounting rim. In certain embodiments, the connector part can include an inner cap and a pump cap, where the inner cap can be configured to be force-fitted into the inner side of the mounting rim so as to tightly contact the inner perimeter of the mounting rim, and the pump cap can be configured to be mounted onto an outer side of the mounting rim to tightly contact the outer perimeter of the mounting rim.

An embodiment of the present invention having the features above can provide various advantageous effects, including the following. However, an embodiment of the present invention may not necessarily exhibit all of the effects below.

An embodiment of the invention can provide a tubeless dispenser container where the structure of the dispenser container itself not only provides a supply path for the content but also effectively separates the supply path of the content from the flow path of the air, so that the tubeless dispenser container is able to dispense the content in a stable manner even without a plastic tube that connects to the pump part.

DETAILED DESCRIPTION OF THE INVENTION

Figure 1:
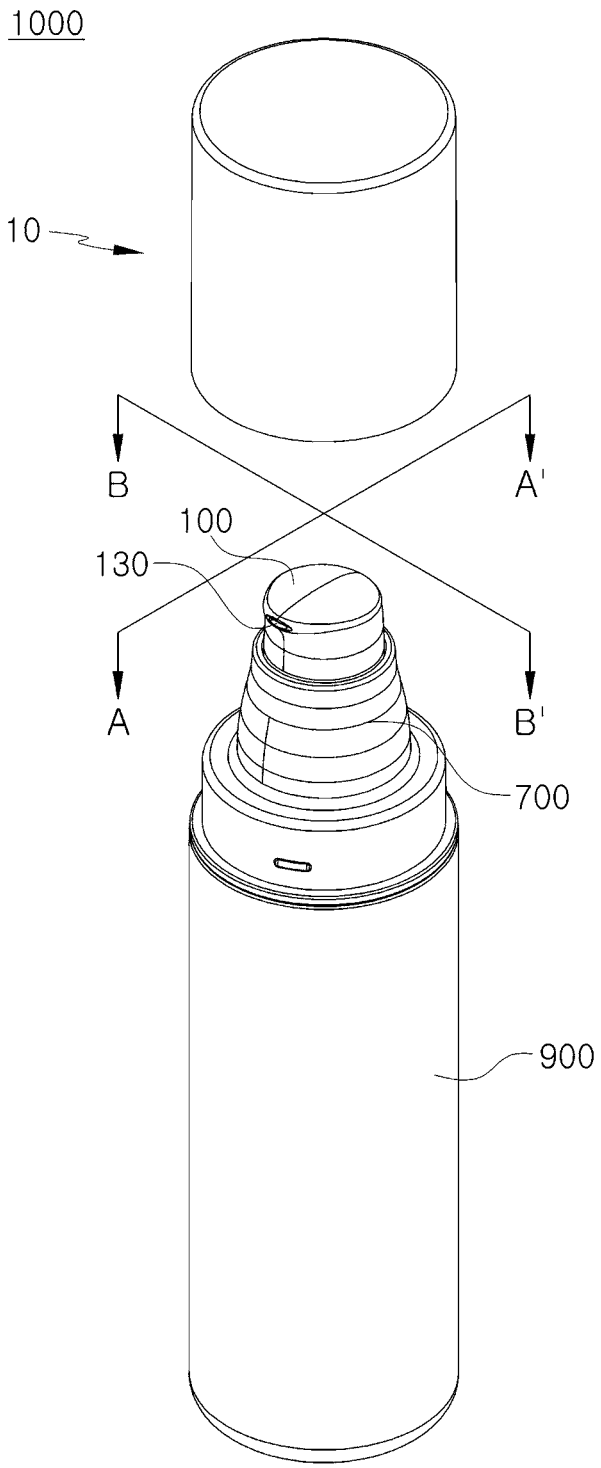
FIG. 1 is a perspective view of a tubeless dispenser container according to an embodiment of the invention, with the overcap separated.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

Figure 2:
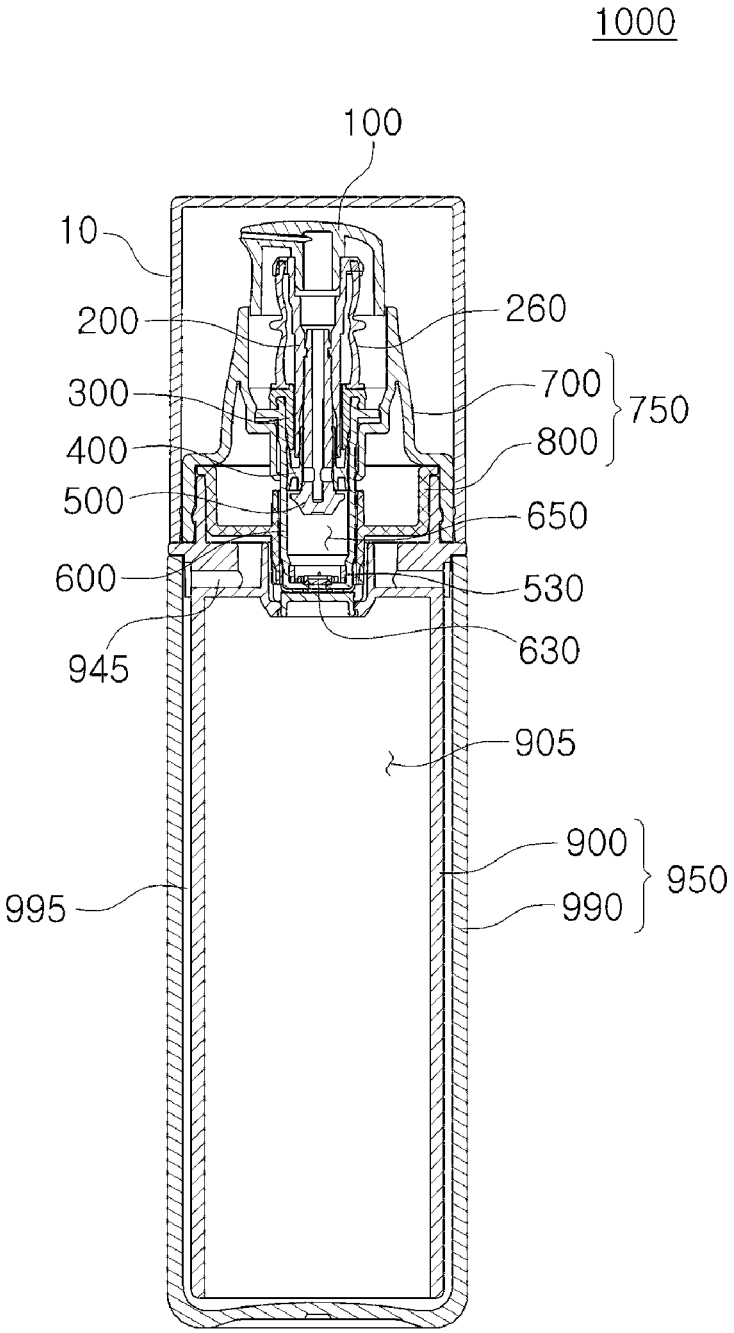
FIG. 2 is a cross-sectional view of the tubeless dispenser container illustrated in FIG. 1 across line A-A'.
Figure 3:
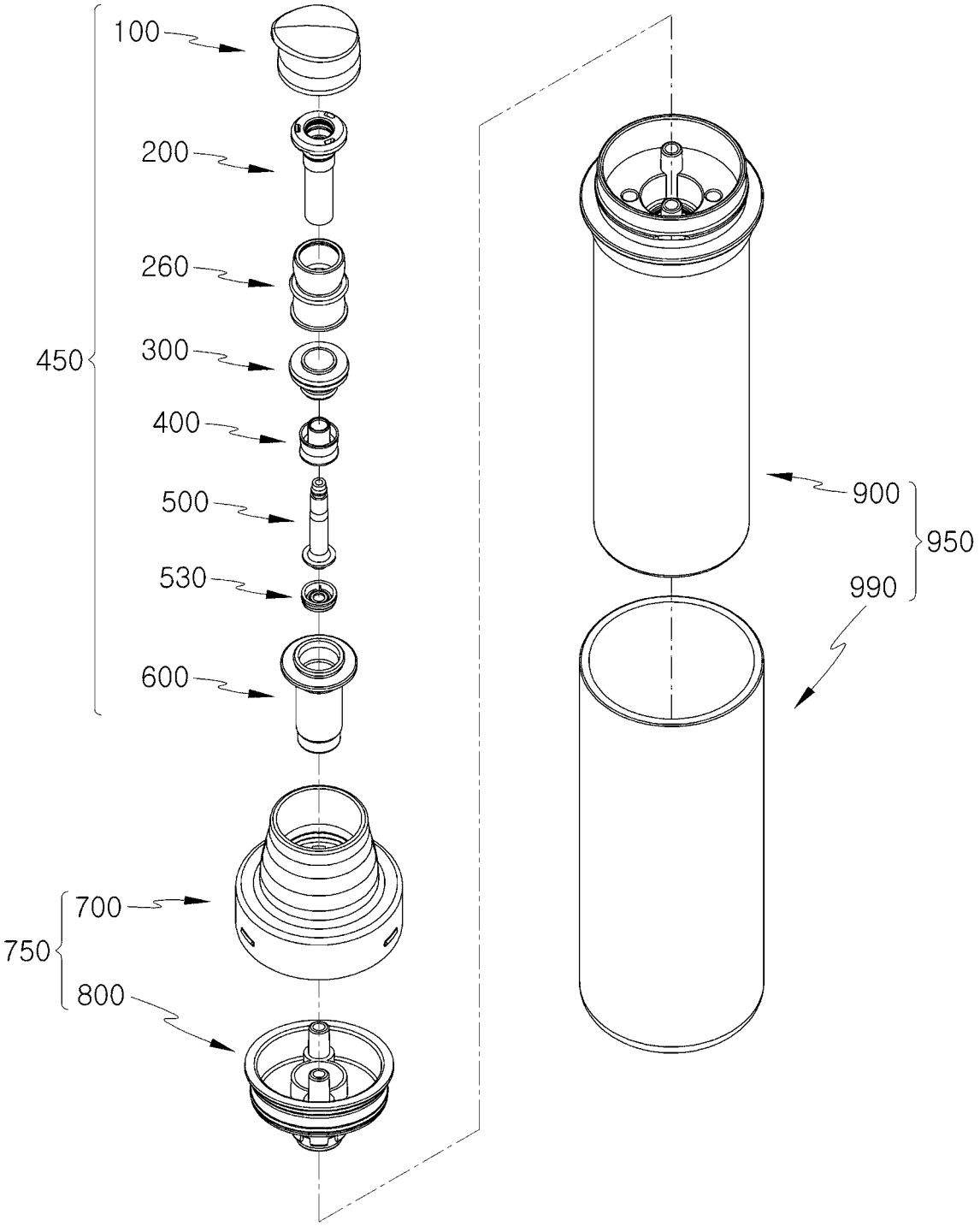
FIG. 3 is an exploded perspective view of the tubeless dispenser container illustrated in FIG. 1.

FIG. 1 is a perspective view of a tubeless dispenser container 1000 according to an embodiment of the invention with the overcap 10 separated, FIG. 2 is a cross-sectional view of the tubeless dispenser container 1000 illustrated in FIG. 1 across line A-A', and FIG. 3 is an exploded perspective view of the tubeless dispenser container 1000 illustrated in FIG. 1.

Referring to FIGS. 1 to 3, a tubeless dispenser container 1000 according to an embodiment of the invention can be a container for dispensing a content (not shown) held within a filling space 905 and can mainly include a bottle part 950, a connector part 750, and a pump part 450.

The bottle part 950 can have the filling space 905 formed in its interior and can have a supply hole 980, for permitting the flow of the content, and an air hole 965, for permitting the inflow of air, formed in its upper surface. A supply channel that connects a lower portion of the filling space 905 with the supply hole 980 can also be formed in the bottle part 950. That is, one end of the supply channel in the bottle part 950 can be connected to the lower portion of the filling space 905, and the other end of the supply channel can be connected to the supply hole 980. Therefore, when there is a content (not shown) filled in the filling space 905, the air hole 965 can be positioned above the surface of the content (not shown), whereas the one end of the supply channel can be positioned below the surface of the content (not shown), with respect to the surface of the liquid phase or gel phase content (not shown).

The connector part 750 can be coupled to an upper portion of the bottle part 950 and can serve to provide a space for placing the pump part 450 and designate the position of the pump part 450 while at the same time spatially separating the supply holes 980 and the air holes 965 of the bottle part 950.

The pump part 450 can be secured to the designated position of the connector part 750 to suction and dispense the content (not shown) supplied through the supply hole 980. That is, after removing the overcap 10, when the user presses the nozzle 100, the pump guide 500 may move down to open the pump inflow holes 540, allowing the content within the pump space 650 to enter the pump inflow holes 540, pass through the guide passage 550, valve space 250, nozzle space 150, and nozzle passage 140, and ultimately be dispensed through the dispensing hole 130.

With a tubeless dispenser container 1000 according to an embodiment of the invention, the bottle part 950 itself can provide a supply channel, obviating the need for a plastic tube as in the prior art. This can resolve the problem of the dispenser container 1000 having a lowered aesthetic due to the crude plastic tube of the interior being visible, even when the bottle part 950 is fabricated from a transparent material.

In a dispenser container that utilizes a pump, suctioning the content requires that the air pressure inside the filling space 905 be kept at a certain level and the pressure at the pump side be kept lower than the air pressure inside the filling space 905. In cases where a plastic tube is connected directly to the pump as in the prior art, such negative pressure can be easily formed simply by increasing the airtightness of the pump itself. However, in cases where the supply channel is formed by coupling several components together as in an embodiment of the invention, it is very important to provide an airtight seal between the portions requiring a negative pressure and the portions kept at a normal pressure.

A more detailed description of an embodiment of the invention is provided below with reference to FIG. 3. A tubeless dispenser container 1000 according to an embodiment of the invention can include the pump part 450, connector part 750, and bottle part 950, as well as an overcap 10 that may be detachably coupled onto the upper portion. Here, the pump part 450 can include a nozzle 100, a valve 200, an elastic element 260, a housing cover 300, a piston 400, a guide 500, a disk 530, and a housing 600; the connector part 750 can include a pump cap 700 and an inner cap 800; and the bottle part 950 can include an inner bottle 900 and an outer bottle 990.

The nozzle 100 can correspond to the portion that may be pressed by the user and may dispense the content correspondingly. The nozzle 100 can be open at the bottom and can have the dispensing hole 130 formed in one side. The nozzle 100 can have a space formed therein, defined by an outer edge 110, and can have a connecting boss 120 formed on an inner side of the outer edge 110. The connecting boss 120 can have a cylindrical shape with an open bottom and can formed a nozzle space 150 therein.

A nozzle passage 140 can be formed in an upper portion of the nozzle 100, where the nozzle passage 140 can have one end connecting to the nozzle space 150 and the other end continuing to the dispensing hole 130. The connecting boss 120 of the nozzle 100 can be inserted into a connecting part 230 of the valve 200 to be coupled and secured onto the valve 200. When the nozzle 100 is moved up and down together with the valve 200, the outer edge 110 of the nozzle 100 can move along the inner perimeter of the inner mounting part 720 of the pump cap 700.

The valve 200 can be coupled to the nozzle 100 and the guide 500 and can manipulate the piston 400 and guide 500 by way of the force applied by the user and the restoring force of the elastic element 260. The valve 200 can have a hollow cylindrical shape overall and can include a head part 210, a connecting part 230, and a cylinder part 240.

The head part 210 can protrude outwardly from the upper end of the valve 200 and extend downward so as to form a connection groove 220. An upper portion 270 of the elastic element 260 can be inserted in and secured to the connection groove 220.

The nozzle 100 and the valve 200 can be coupled to each other, as the connecting boss 120 of the nozzle 100 is inserted into the connecting part 230. As shown in the drawings, a curb can be formed on each of the connecting boss 120 and the connecting part 230, and the curbs can be configured to contact each other, so that when the nozzle 100 is pressed down, the valve 200 can be pressed downward by the nozzle 100, and when the valve 200 is moved up, the nozzle 100 can be pressed upward by the valve 200. It would be possible to couple the connecting boss 120 and the connecting part 230 more securely by forming a protrusion and an indentation configured to mate with each other on the outer perimeter of the connecting boss 120 and the inner perimeter of the connecting part 230. When the connecting boss 120 is inserted into the connecting part 230, the valve space 250 of the valve 200 can connect with the nozzle space 150 of the nozzle 100.

The cylinder part 240 can be configured in the shape of a hollow cylinder. A stem 520 of the guide 500 can be inserted into the interior space of the cylinder part 240, and as such, the interior space of the cylinder part 240 can have an inner diameter corresponding to the outer diameter of the stem 520. However, at a lower portion of the interior space of the cylinder part 240, an inner contact part 430 of the piston 400 can also be inserted, and the interior space of the cylinder part 240 can have a larger inner diameter at the lower portion correspondingly. It would be possible to couple the valve 200 and the guide 500 more securely by forming a coupling protrusion 245 on the inner perimeter of the cylinder part 240 and a corresponding indentation in the outer perimeter of the stem 520.

The elastic element 260 can be coupled between the valve 200 and the housing cover 300 or housing 600 and can serve to return the nozzle 100, valve 200, and guide 500 to their original positions by way of an elastic force when the external force applied by the user is removed. An elastic element 260 based on an embodiment of the invention can be made from a material capable of elastic deformation and can be shaped as a hollow tube overall. The upper portion 270 of the elastic element 260 can be coupled to the valve 200, for example by being inserted into the connection groove 220 of the head part 210, etc., and a lower portion 290 of the elastic element 260 can be coupled to the housing cover 300 or housing 600 by a similar method. For example, the drawings illustrate an example in which a portion of the housing cover 300 is inserted to the inner side of the lower portion 290 of the elastic element 260.

A reinforcement rib 280 can be formed in the middle of the elastic element 260. The reinforcement rib 280, which may be a portion that is formed with a greater thickness to limit the elastic deformation, can enable the elastic element 260 to provide a restoring force more effectively by preventing folding, buckling, etc., in a portion of the elastic element 260.

The housing cover 300 can be coupled to an upper portion of the to increase airtightness between the valve 200 and the housing 600. The housing cover 300 can include a head part 310 that is located at the top and a contact part 330 that extends to a particular length along the vertical direction. The head part 310 of the housing cover 300 can protrude outwardly from the upper end of the housing cover 300 and extend downward so as to form a connection groove 320. An upper portion of the housing 600 can be inserted in and secured to the connection groove 320 of the housing cover 300. The cylinder part 240 of the valve 200 can be configured to move up and down within the housing 600, where the cylinder part 240 can be inserted through the center hole of the contact part 330. As the tight contact between the valve 200 and the housing cover 300, provided in the form of surface contact over the vertical length of the contact part 330, can provide a high level of airtightness for maintaining separated pressure environments in the interior of the housing 600 and in the pump space 650.

The piston 400 can be mounted onto the stem 520 of the guide 500 and can include an outer contact part 410, a bridge 420, and an inner contact part 430. The outer contact part 410 can be configured to tightly contact the inner perimeter of the housing 600, and the inner contact part 430 can be configured to contact the stem 520 of the guide 500. The bridge 420 can connect the outer contact part 410 and the inner contact part 430 with each other. When the nozzle 100 is not pressed, the piston 400 can be arranged at a position that closes the pump inflow holes 540 formed in the guide 500.

The guide 500 can be coupled to the valve 200 and can be configured to move up and down within the housing 600 according to the force applied by the user. The guide 500 can include a head part 510 and a stem 520. The head part 510 can be positioned within the pump space 650 of the housing 600 and can have a larger diameter than that of the piston 400, thereby forming a curb below the piston 400. The stem 520 can be elongated and can have the shape of a hollow cylinder through which a guide passage 550 is formed, where one or more pump inflow holes 540 formed in the stem 520 can connect the guide passage 550 with the outside of the guide 500.

The disk 530 can be arranged at a lower portion of the housing 600 and can include multiple holes, so that even when the guide 500 is moved down as far as possible, the housing inflow hole 630 in the bottom of the housing 600 remains unclosed.

The housing 600 can form a pump space 650, into which the content can be suctioned and in which the piston 400 and guide 500 may move up and down. The housing 600 can include a flange 610 and a body 620. The body 620 of the housing 600 can be inserted into the holding space 850 of the inner cap 800, and the pump space 650 can be formed inside the body 620. One or more housing inflow hole 630 can be formed in a designated position in a lower portion of the body 620. The flange 610 can protrude outward from an upper portion of the housing 600 and can facilitate the coupling of the housing 600 onto the connector part 750.

When the user presses the nozzle 100, the nozzle 100 as well as the valve 200 and guide 500 coupled to the nozzle 100 may move down together, whereas the piston 400 may not move down immediately, due to the friction caused by the tight contact with the housing 600. As the piston 400 does not move down but the guide 500 does move down, the pump inflow holes 540 of the guide 500 can be opened. After the guide 500 has moved down by a particular distance, the lower end of the valve 200 can press the bridge 420 of the piston 400 and cause the piston 400 to move down together, but at this time, the pump inflow holes 540 of the guide 500 can maintain opened states. As the guide 500 moves downward, the volume of the pump space 650 can be decreased, and the resulting increase in pressure can suction the content (not shown), which was previously drawn into the pump space 650, through the opened pump inflow holes 540. The content that enters the pump inflow holes 540 can pass through the guide passage 550, valve space 250, nozzle space 150, and nozzle passage 140 and be dispensed through the dispensing hole 130.

When the user stops pressing on the nozzle 100, the nozzle 100 as well as the valve 200 and guide 500 coupled to the nozzle 100 may be moved up together by the restoring force of the elastic element 260, but once again, the piston 400 may not move up immediately, due to the friction caused by the tight contact with the housing 600. As the piston 400 does not move up but the guide 500 does move up, the pump inflow holes 540 of the guide 500 can be closed. After the guide 500 has moved up by a particular distance, the head part 510 of the guide 500 can press the piston 400 and cause the piston 400 to move up together, but at this time, the pump inflow holes 540 of the guide 500 can maintain closed states. As the guide 500 moves upward, the volume of the pump space 650 can be increased, and the resulting decrease in pressure can draw the content (not shown) of the filling space 905 through the supply channel into the pump space 650.

Some of the components of the pump part 450 can be combined into a single integrated body as long as such integration does not inhibit the operations described above.

The following provides a more detailed description of the bottle part 950 of a tubeless dispenser container 1000 according to an embodiment of the invention.

Figure 4:
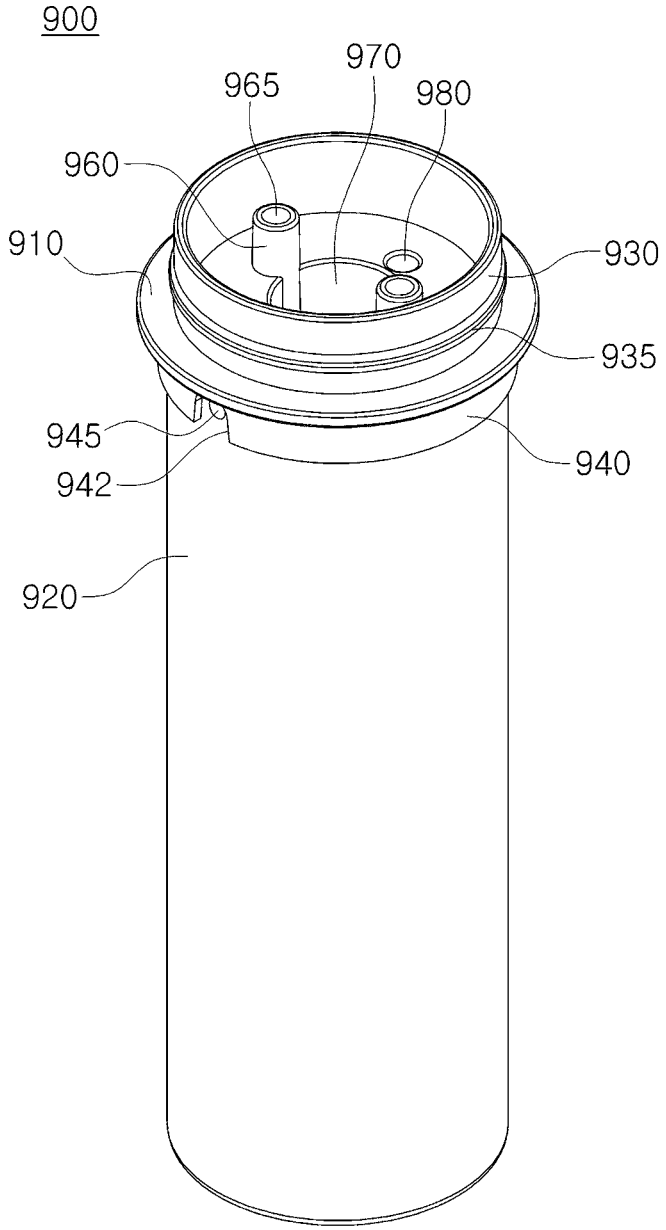
FIG. 4 is a perspective view of the inner bottle of the tubeless dispenser container illustrated in FIG. 1.
Figure 5A:
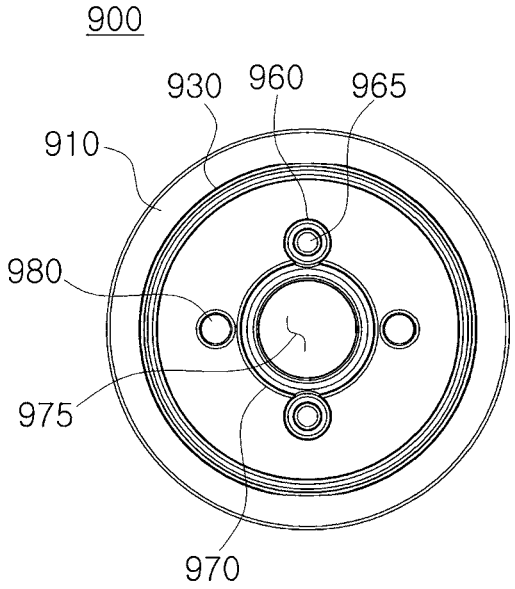
FIG. 5A is a top view of the inner bottle illustrated in FIG. 4.
Figure 5B:
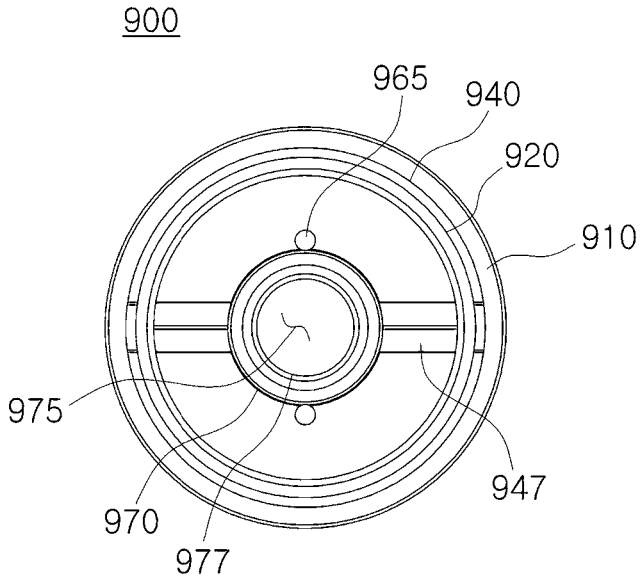
FIG. 5B is a bottom view of the inner bottle illustrated in FIG. 4.

FIG. 4 is a perspective view of the inner bottle 900 of the tubeless dispenser container 1000 illustrated in FIG. 1, and FIG. 5A and FIG. 5B are a top view and a bottom view, respectively, of the inner bottle 900 illustrated in FIG. 4.

Referring to FIGS. 2 to 5B, the bottle part 950 can include an inner bottle 900 and an outer bottle 990. The inner bottle 900 can be shaped as a hollow cylinder overall, with a filling space 905 formed therein and with an open bottom. A channel part 947 forming an upper channel 945 can be provided at an upper portion of the inner bottle 900, where the upper channel 945 can have one end opening into the outer perimeter of the inner bottle 900 and the other end continuing to the supply hole 980.

The outer bottle 990 can also be shaped as a hollow cylinder overall, but the outer bottle 990 can have a closed bottom. When the inner bottle 900 is inserted into the outer bottle 990, the space 995 between the inner perimeter of the outer bottle 990 and the outer perimeter of the inner bottle 900 can form a portion of the supply channel.

That is, as illustrated in FIG. 2, when the inner bottle 900 is coupled with the outer bottle 990, a particular gap can be formed between the outer perimeter of the inner bottle 900 and the inner perimeter of the outer bottle 990, and a particular gap can be formed also between the open bottom portion of the inner bottle 900 and the bottom surface of the outer bottle 990. When the content of the filling space 905 is to be drawn into the pump space 650, the content of the filling space 905 can move through the open bottom of the inner bottle 900 into the space 995 between the outer bottle 990 and inner bottle 900, move up along the outer perimeter of the inner bottle 900 and into the upper channel 945 by way of a negative pressure, move through the supply hole 980 into the recessed part 970, and move through the housing inflow hole 630 into the pump space 650.

Referring to FIG. 4, FIG. 5A, and FIG. 5B, the inner bottle 900 can mainly include a flange 910, a body 920, a mounting rim 930, and airduct protrusions 960.

The flange 910 can be formed protruding outward from an upper portion of the inner bottle 900 and can provide a step onto which the pump cap 700 and the overcap 10 may be placed when coupled. In an embodiment of the invention, the flange 910 can also be used in association with the coupling of the inner bottle 900 and the outer bottle 990.

The body 920 can extend vertically while maintaining a certain outer diameter along most of its length. The body 920 can have an open bottom and can have the filling space 905 formed in its inside. In a preferred embodiment, the body 920 can be formed from a completely transparent or semi-transparent material.

The mounting rim 930 can have an annular shape and can protrude by a particular length from the upper surface of the inner bottle 900. The mounting rim 930 can be placed in tight contact with the connector part 750 in order to seal the supply channel as well as to couple the connector part 750 onto the bottle part 950. The outer perimeter of the mounting rim 930 can be provided with a protrusion 935 for coupling and sealing the connector part 750.

The airduct protrusions 960 can protrude upward to a particular length from the upper surface of the inner bottle 900. The airduct protrusions 960 can be formed in the shape of a hollow cylinder, where the passages inside the airduct protrusions 960 can connect with the air holes 965. That is, the passage inside an airduct protrusion 960 can be regarded as an extension of an air hole 965.

A recessed part 970 can be formed in the upper surface of the inner bottle 900. The recessed part 970 can be formed in correspondence to the position of the pump part 450 so as to hold portions of the pump part 450 and the connector part 750. Of course, in certain embodiments, the recessed part 970 can be omitted or implemented as another structure.

In an embodiment of the invention, a filling hole 975 can be formed in the bottom surface of the recessed part 970. The filling hole 975 can be an opening that connects to the filling space 905 and can be used as an entrance for filling the content into the tubeless dispenser container 1000. The filling hole 975 can be configured to be closed later when a portion of the connector part 750 or a portion of the pump part 450 is inserted into the recessed part 970, and to this end, a detent protrusion 977 can be formed on the inner perimeter of the filling hole 975. In another embodiment not illustrated in the drawings, the filling hole 975 can be formed in another location such as the bottom surface of the outer bottle 990, etc.

One or more supply holes 980 can also be formed in the upper surface of the inner bottle 900. As described above, the supply hole 980 can correspond to an end portion of an upper channel 945. A channel part 947 having a hollow core can be formed in a lower portion on the inner side of the upper surface of the inner bottle 900, thereby forming an upper channel 945 in the inside of the channel part 947, where one end of the upper channel 945 can be opened to the outer perimeter of the inner bottle 900, and the other end can continue to a supply hole 980.

The body 920 of the inner bottle 900 can maintain a constant outer diameter but can have an outer diameter that is smaller than the inner diameter of the outer bottle 990 such that a narrow space 995 is formed between the inner bottle 900 and the outer bottle 990. However, as illustrated in FIG. 4, a widened part 940 having a larger outer diameter than the remaining portions of the body 920 can be formed below the flange 910 at an upper portion of the body 920 of the inner bottle 900.

The widened part 940 can have an outer diameter corresponding to the inner diameter of the outer bottle 990 to tightly contact the inner perimeter of the outer bottle 990. An inflow hole 942 can be formed in the widened part 940 at a position corresponding to an end portion of the upper channel 945, and the end portion of the upper channel 945 can be formed within the inflow hole 942.

When the inner bottle 900 and outer bottle 990 are coupled, the body 920 of the inner bottle 900 can be inserted into the inside of the outer bottle 990. In an embodiment of the invention, the bottle part 950 itself is to provide a supply channel, instead of having a plastic tube inserted in the filling space 905, and to this end, a gap of a particular size may be formed between the open bottom of the inner bottle 900 and the bottom surface of the outer bottle 990, and a space 995 of a particular width may be formed also between the outer perimeter of the inner bottle 900 and the inner perimeter of the outer bottle 990.

When the body 920 of the inner bottle 900 is inserted through the open top of the outer bottle 990, the flange 910 of the inner bottle 900 can be caught on the upper portion of the outer bottle 990 to prevent the inner bottle 900 from moving in any further, and when the inner bottle 900 is at this position, the required gap can be formed between the bottom of the body 920 of the inner bottle 900 and the bottom surface of the outer bottle 990.

Since the widened part 940, which is located below the flange 910, can have an outer diameter corresponding to the inner diameter of the outer bottle 990 and thus can be secured in tight contact with the inner perimeter of the outer bottle 990, the body 920 of the inner bottle 900 can be aligned in the designed position and can form the required gap between the outer perimeter of the inner bottle 900 and the inner perimeter of the outer bottle 990 when the widened part 940 is inserted into the outer bottle 990. Here, as the widened part 940 tightly contacts the inner perimeter of the outer bottle 990, the content may be unable to pass at the widened part 940, but since one end of the upper channel 945 is formed inside the inflow hole 942 such that the end of the upper channel 945 is not closed, and since the inflow hole 942 is open in the downward direction, the upper channel 945 can connect with the space 995 between the inner bottle 900 and outer bottle 990.

Although the drawings illustrate an example in which the lower portion of the inner bottle 900 has a cylindrical shape with a constant height, the lower portion of the inner bottle 900 can partially have a different height to contact the bottom surface of the outer bottle 990. Also, a portion having an outer diameter corresponding to the inner diameter of the outer bottle 990, in a manner similar to that of the widened part 940, can also be formed on the lower portion of the inner bottle 900. Of course, in this case, a recess or a hole can be formed in the necessary position such that the supply channel for the content is not blocked. In an embodiment in which the inner bottle 900 and the outer bottle 990 also contact each other at a lower portion of the inner bottle 900 as described above, it would be possible to apply ultrasonic welding, etc., to the contacting portions. However, welding a lower portion of the inner bottle 900 to the bottom surface of the outer bottle 990 entails a risk of defects caused by the gap between the inner bottle 900 and outer bottle 990 differing from the designed value, and providing a widened part at a lower portion of the inner bottle 900 can make it difficult to insert the inner bottle 900 into the outer bottle 990. As such, it can be advantageous to implement the coupling of the inner bottle 900 and outer bottle 990 at an upper portion, as in the embodiments illustrated in the drawings.

When a content is filled in the filling space 905, the upper air holes 965 can be located in the upper surface of the inner bottle 900, i.e., at a position above the surface of the liquid or gel phase content (not shown), whereas one end of the supply channel can be located at a lower portion of the inner bottle 900, i.e., at a position below the surface of the content (not shown). Thus, the flow path of the content and the flow path of the air can be spatially separated by the content itself until the content (not shown) is used up, allowing the flow paths for the content and the air to have different pressure conditions.

A tubeless dispenser container 1000 according to an embodiment of the invention may have the container itself provide the supply channel instead of using a plastic tube, and therefore a high level of airtightness between the flow path of the content and the flow path of the air is required throughout the structure of the tubeless dispenser container 1000. The following provides a more detailed description of the structure of the connector part 750, which allows a tubeless dispenser container 1000 according to an embodiment of the invention to maintain a high level of airtightness.

Figure 6A:
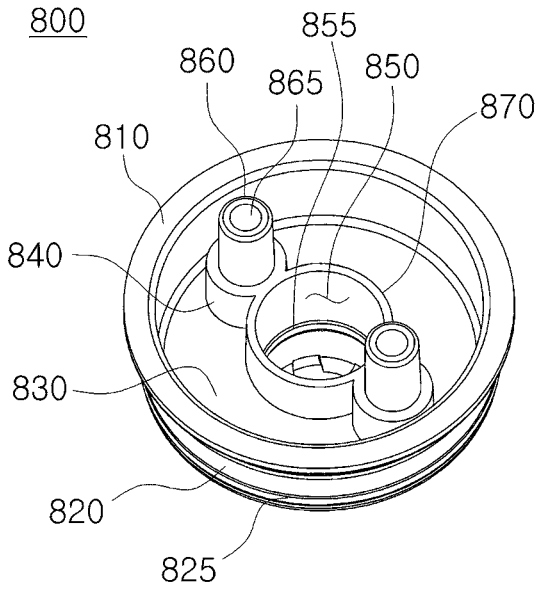
FIG. 6A and FIG. 6B are perspective views of the inner cap of the tubeless dispenser container illustrated in FIG. 1.
Figure 6B:
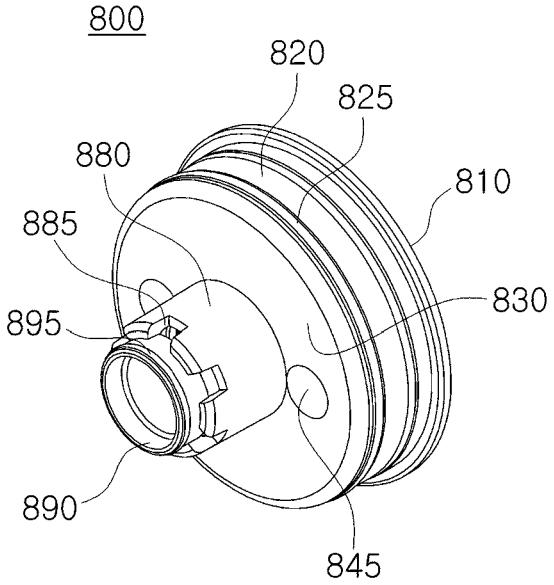
Figure 7A:
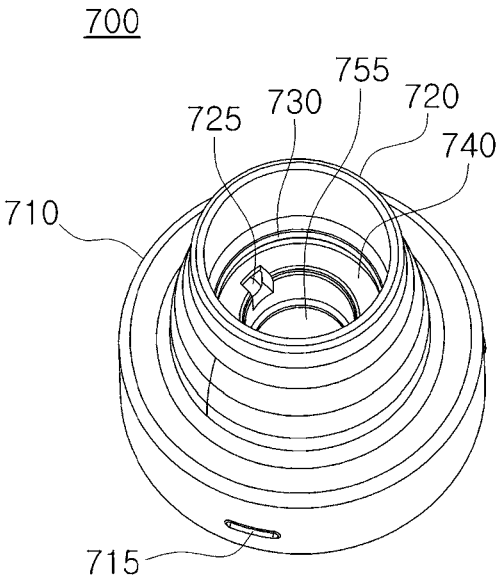
FIG. 7A and FIG. 7B are perspective views of the pump cap of the tubeless dispenser container illustrated in FIG. 1.
Figure 7B:
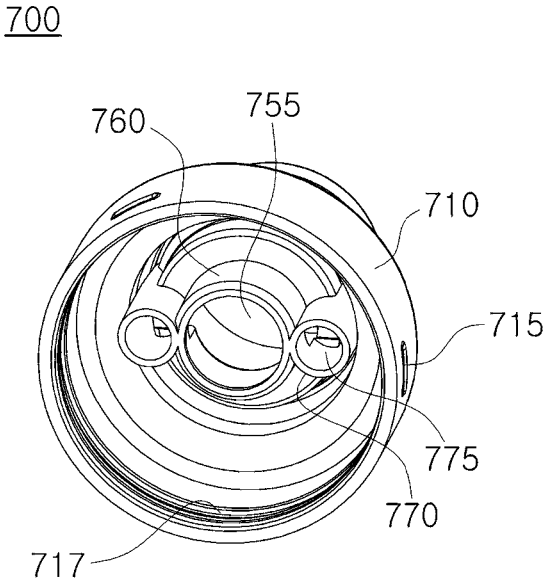

FIG. 6A and FIG. 6B are perspective views of the inner cap 800 of a tubeless dispenser container 1000 according to an embodiment of the invention, and FIG. 7A and FIG. 7B are perspective views of the pump cap 700 of a tubeless dispenser container 1000 according to an embodiment of the invention.

Referring to FIGS. 6A and 6B, the inner cap 800 of a tubeless dispenser container 1000 based on an embodiment of the invention can mainly include a flat part 830 that is shaped as a circular plate, a contact rim 820 that extends upward from the edge of the flat part 830, a flange 810 that extends outward from an upper portion of the contact rim 820, insertion parts 840 and protrusion parts 860 that protrude upward from the flat part 830, and holding parts 870, 880 that protrude upward and downward from the middle of the flat part 830.

The flat part 830 can be implemented in the shape of a circular plate and can be implemented in a size corresponding to the area of the upper surface of the inner bottle 900 inside the mounting rim 930. The contact rim 820 can extend upward from the edge of the flat part 830, and the flange 810 can be formed extending outward from the end portion of the contact rim 820.

The outer diameter of the contact rim 820 can be formed in a size corresponding to the inner diameter of the mounting rim 930 of the inner bottle 900. Thus, the inner cap 800 can be coupled to an upper portion of the inner bottle 900 by way of force-fitting into the inside of the mounting rim 930, as a result of which the outer perimeter of the contact rim 820 can tightly contact the inner perimeter of the mounting rim 930. To provide increased airtightness, one or more sealing protrusions 825 can be formed on the outer perimeter of the contact rim 820. The extending length of the contact rim 820 can be made slightly shorter than the extending length of the mounting rim 930. Thus, when the inner cap 800 is mounted on the inner bottle 900, the flange 810 of the inner cap 800 can be caught on an upper portion of the mounting rim 930, and the flat part 830 may not tightly contact the upper surface of the inner bottle 900, and the resulting gap between the flat part 830 and the upper surface of the inner bottle 900 can form a portion of the supply channel between the upper channel 945 and the holding space 850 described later on.

An insertion part 840 can protrude upward from the flat part 830 and can have the shape of a hollow cylinder, forming an insertion cavity 845 therein that opens downward. A protrusion part 860 having the shape of a hollow cylinder can be formed at an upper portion of the insertion part 840, where the passage 865 of the protrusion part 860 can connect with the insertion cavity 845. However, the insertion cavity 845 can be formed with an inner diameter that is greater than the inner diameter of the passage 865 of the protrusion part 860.

When the inner cap 800 is mounted on the inner bottle 900, the airduct protrusions 960 of the inner bottle 900 can be force-fitted into the insertion cavities 845, and the outer perimeters of the airduct protrusions 960 can be placed in tight contact with the inner perimeters of the insertion parts 840. In this state, the passages of the airduct protrusions 960 (i.e., the air holes 965) can connect with the passages 865 of the protrusion parts 860. Thus, the protrusion parts 860 can be regarded as extensions of the airduct protrusions 960. The inner diameters of the insertion parts 840 can correspond to the outer diameters of the airduct protrusions 960, and the inner diameters of the protrusion parts 860 can correspond to the inner diameters of the airduct protrusions 960.

In a structure requiring airtightness, one of the positions where undesired air infiltration is most likely to occur is at the boundaries between components. Since a tubeless dispenser container 1000 according to an embodiment of the invention requires airflow at the air holes 965 connecting to the filling space 905 but requires a thorough blocking of airflow at other portions, airtight sealing around the airduct protrusions 960 of the inner bottle 900 is especially important. By having the airduct protrusions 960 extend a particular length and be force-fitted into the insertion cavities 845 of a particular depth, the boundary between the inner cap 800 and the inner bottle 900 formed around the airduct protrusions 960 can be increased in length. Thus, the potential paths for air infiltration at the boundary between the inner cap 800 and the inner bottle 900 can be blocked by surface contact over a large distance, thus effectively blocking any undesired air infiltration.

The holding parts 870, 880 can protrude upward and downward with respect to the flat part 830 and can have a hollow inside to thereby form a holding space 850 therein. The holding part 870 formed above the flat part 830 can be open in an upward direction, while the holding part 880 formed below the flat part 830 can be implemented with a closed bottom. The pump part 450 can be inserted and installed within the holding space 850. To facilitate the securing of and sealing around the pump part 450, one or more sealing protrusions 855 can be formed in the holding space 850.

In the holding part 880 formed below the flat part 830, there can be formed one or more holding-part inflow hole 885. The holding-part inflow holes 885 can connect the outside of the holding part 880 with the inside, so as to connect the inside of the recessed part 970 with the inside of the holding part 880. Thus, the content that was directed from the filling space 905 through the upper channels 945 to the supply holes 980 can move into the recessed part 970 adjacent to the supply holes 980, pass through the space between the inner perimeter of the recessed part 970 and the outer perimeter of the holding part 880, and move through the holding-part inflow holes 885 to the inside of the holding space 850, to subsequently move from the inside of the holding space 850 through the housing inflow hole 630 into the pump space 650.

In cases where the filling hole 975 is formed in the recessed part 970 of the inner bottle 900, a plug 890 can be provided at the lower end of the holding part 880 formed below the flat part 830. The plug 890 can be inserted into the filling hole 975 to close the filling hole 975. A protrusion 895 can be formed on the outer perimeter of the plug 890 such that the protrusion 895 can be caught on a curb formed around the filling hole 975 of the inner bottle 900, to thereby secure the inner cap 800 and at the same time prevent any air infiltration through the filling hole 975. An O-ring, etc., for increasing airtightness can further be provided at the plug 890. In cases where the filling hole 975 is formed in another location, such as in the bottom surface of the outer bottle 990, etc., it would be possible to omit the plug 890.

The bottom surface of the flat part 830 of the inner cap 800 may form a part of the supply path for the content (not shown), and insertion cavities 845 forming the flow path for air may be formed in the lower surface of the flat part 830. However, since the air holes 965 connecting to the filling space 905 continue to the upper portions of the airduct protrusions 960, the air holes 965 may not be exposed at the lower surface of the flat part 830. That is, at the boundary from the exit of an air hole 965 to the lower surface of the flat part 830, the potential path of airflow may be blocked by surface contact over a length corresponding to the depth of the insertion cavity 845, whereby a high level of airtightness can be obtained, and the flow paths for the content and the air can be separated spatially.

Referring to FIGS. 7A and 7B, the pump cap 700 of a tubeless dispenser container 1000 based on an embodiment of the invention can mainly include an outer mounting part 710 and an inner mounting part 720.

The outer mounting part 710 can include a part formed in an annular shape and a part extending inward from the annularly shaped part. The outer mounting part 710 can be placed in tight contact with and be coupled to the outside of the mounting rim 930 of the inner bottle 900. One or more protrusions 717 can be provided on the inner perimeter of the outer mounting part 710 to facilitate the coupling and sealing with respect to the mounting rim 930 of the inner bottle 900. Also, one or more detent protrusions 715 can be provided on the outer perimeter of the outer mounting part 710 to allow a detachable coupling of the overcap 10.

The inner mounting part 720 can be formed extending with an incline in a frustoconical shape, and the nozzle 100 can be exposed at the open top. The inner mounting part 720 can provide a space for housing the pump part 450 and can secure the housing cover 300 and the nozzle 100.

On the inside of the inner mounting part 720, there can be formed a curb part 740, which may protrude inward to provide a curb, as well as a securing part 760, which may protrude downward from the inner side of the curb part 740. The securing part 760 can have the shape of a hollow cylinder and can form a through-hole 755 therein. As illustrated in FIGS. 7A and 7B, insertion parts 770 can also be formed on a lower portion of the curb part 740, where the insertion parts 770 can have the shape of a hollow cylinder to form insertion cavities 775 therein. Cavities can be formed in designated locations of the curb part 740, and the air holes 725 can be formed inside such cavities.

When the pump cap 700 and the inner cap 800 are coupled to each other, the protrusion part 860 of the inner cap 800 can be force-fitted into the insertion cavity 775 of the pump cap 700, and the outer perimeter of the protrusion part 860 can tightly contact the inner perimeter of the insertion part 770. In this state, the passages 865 of the protrusion parts 860 can be connected with the air holes 725 of the curb part 740. Thus, the air holes 965 formed in the upper portion of the filling space 905 can, by way of the air holes 965 in the airduct protrusions 960 of the inner bottle 900, the passages 865 in the protrusion parts 860 of the inner cap 800, and the air holes 725 in the pump cap 700, be connected with the outside.

When the pump part 450 is coupled to the pump cap 700, the pump part 450 can be inserted through the through-hole 755 of the inner mounting part 720 and can be disposed within the recessed part 970 of the inner bottle 900 and the holding space 850 of the inner cap 800. When the pump part 450 is pressed and inserted with a sufficient force, the head part 310 of the housing cover 300 can be forced under the securing protrusion 730 of the curb part 740, and the head part 310 can be secured between the curb part 740 and the securing protrusion 730. Of course, in certain embodiments, the structure can be modified such that the head part 310 of the housing cover 300 is positioned between the pump cap 700 and the inner cap 800. However, the structure of the embodiment illustrated in the drawings can simplify the assembly process to thereby provide advantages in time and cost reduction.

Some of the components of the connector part 750, i.e., the pump cap 700 and inner cap 800, can be combined into a single integrated body as long as such integration does not inhibit the operations described above. However, these can also be fabricated separately and assembled together for easier manufacture and assembly.

Figure 8:
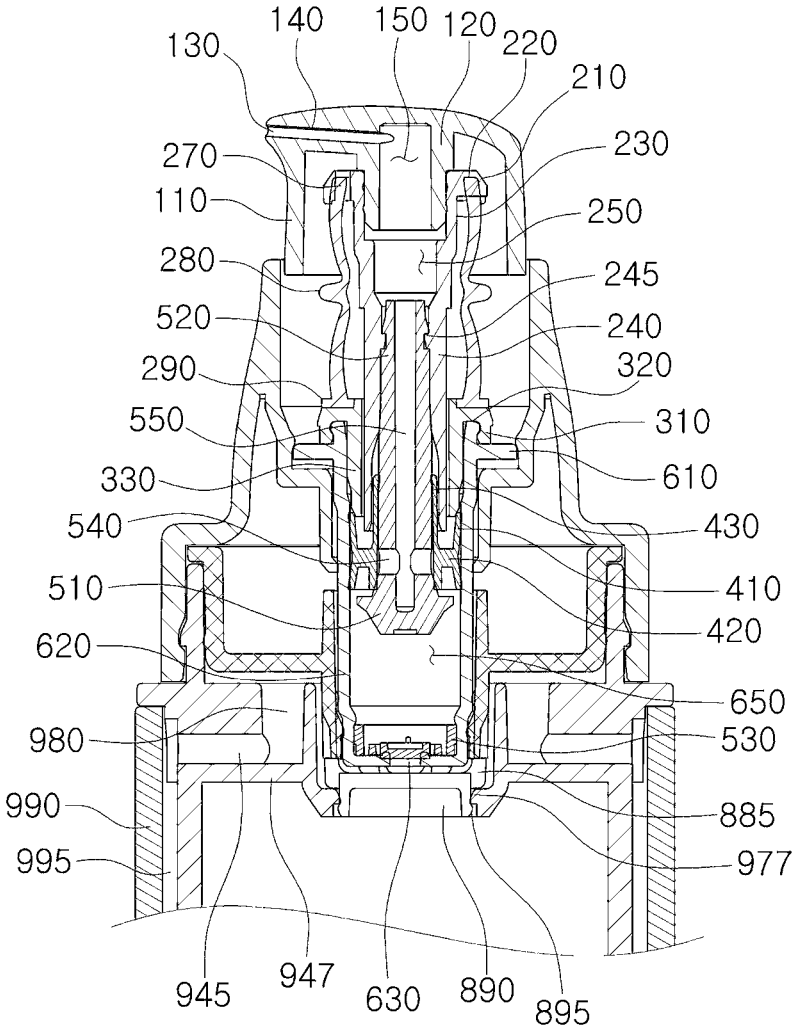
FIG. 8 is a cross-sectional view of a portion of the tubeless dispenser container illustrated in FIG. 1 across line A-A'.
Figure 9:
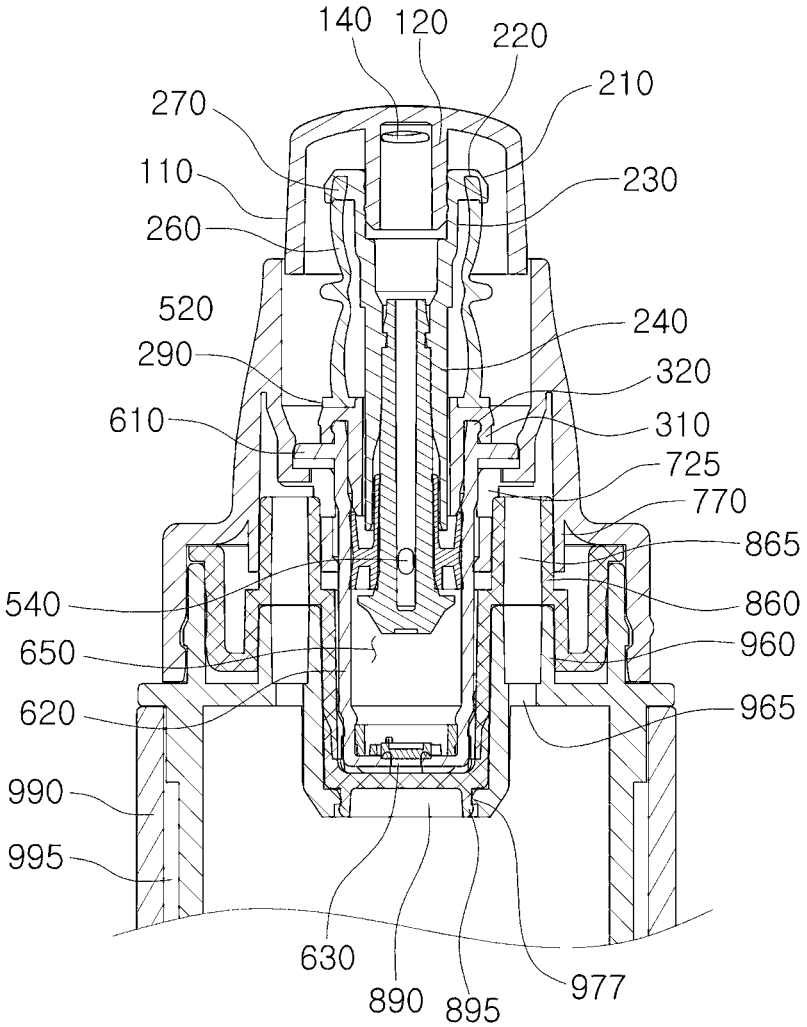
FIG. 9 is a cross-sectional view of a portion of the tubeless dispenser container illustrated in FIG. 1 across line B-B'.

A more detailed description is provided below, with reference to FIGS. 8 and 9, of the flow paths of the content and the air within a tubeless dispenser container 1000. FIG. 8 and FIG. 9 is a cross-sectional view of a portion of the tubeless dispenser container 1000 illustrated in FIG. 1 across line A-A' and line B-B', respectively.

First, referring to FIG. 2 and FIG. 8, when the user presses the nozzle 100 from the state shown in FIG. 8 and subsequently stops pressing on the nozzle 100 so that a negative pressure is created within the pump space 650, the content (not shown) in the filling space 905 may move from the lower portion of the filling space 905 and through the space 995 between the inner bottle 900 and outer bottle 990 to arrive at the upper portion of the inner bottle 900, and after moving through the upper channels 945 to the supply holes 980, the content can enter the recessed part 970 and move through the housing inflow holes 630 to be supplied to the pump space 650. Later, when the nozzle 100 is pressed again, the content within the pump space 650 can pass through the pump part 450 to be dispensed through the dispensing hole 130 of the nozzle 100.

Referring to FIG. 9, the airduct protrusions 960 of the inner bottle 900 may be inserted in the insertion cavities 845 of the inner cap 800, and the protrusion parts 860 of the inner cap 800 may be inserted in the insertion cavities 775 of the pump cap 700. As a result, the air holes 965 formed in the upper surface of the inner bottle 900 can be connected, by way of the protrusion parts 860 of the inner cap 800 and the insertion parts 770 of the pump cap 700, with the air holes 725 in the inner mounting part 720 of the pump cap 700.

As presented above, a tubeless dispenser container 1000 according to an embodiment of the invention can provide a supply channel for the content using the structure of the container itself without using a separate plastic tube. Unlike conventional containers that use a separate plastic tube, a tubeless dispenser container 1000 according to an embodiment of the invention requires high airtightness at each component of the dispenser container and requires an effective prevention of air infiltration particularly at the contact boundaries between different components, as these are particularly vulnerable to air infiltration.

A tubeless dispenser container 1000 according to an embodiment of the invention includes a small number of components to begin with, some of which may be integrated into a single body to provide an even smaller number of components. As the container includes a small number of components, the boundaries between components can be decreased, and the risk of air infiltration can be greatly reduced. Also, as illustrated in FIGS. 8 and 9, a tubeless dispenser container 1000 according to an embodiment of the invention has the portions vulnerable to air infiltration blocked by surface contact over a particular length at the boundaries between the inner bottle 900, inner cap 800, and pump cap 700. That is, members such as the mounting rim 930, protrusion parts 860, holding parts 870, 880, airduct protrusions 960, etc., extend beyond a particular length and provide surface contact over the entire extending length.

Such a structure can greatly enhance the airtightness at the contact boundaries between components, which can be particularly vulnerable to undesired air infiltration, thereby allowing the tubeless dispenser container 1000 to smoothly perform a dispensing function using the structure itself and without using a separate plastic tube. In the embodiment illustrated in the drawings, the structure described above can be omitted at certain portions, such as around the filling hole 975 and at one end of the upper channel 954, where airtightness can be easily obtained using other methods such thermal welding, applying O-rings, etc.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A tubeless dispenser container for dispensing a content held in a filling space, the tubeless dispenser container comprising:

a bottle part having the filling space formed therein and having a supply hole and an air hole formed in an upper surface thereof, the supply hole being configured to allow a flow of the content, the air hole being configured to allow an inflow of air;

a connector part coupled to an upper portion of the bottle part to spatially separate the supply hole from the air hole; and a pump part secured to a designated position of the connector part and configured to suction and dispense the content supplied through the supply hole, wherein the bottle part has a supply channel formed therein, the supply channel connecting a lower portion of the filling space with the supply hole, wherein the bottle part comprises:

an inner bottle having the filling space formed therein, having an open bottom, and having an upper channel formed in an upper portion thereof, the upper channel being connecting with the supply hole; and an outer bottle having an inner diameter greater than an outer diameter of the inner bottle to house the inner bottle therein, the outer bottle having a closed bottom, wherein the upper channel has one end open towards an outer perimeter of the inner bottle and another end continuing to the supply hole, wherein the supply channel comprises the upper channel and a space between an inner perimeter of the outer bottle and the outer perimeter of the inner bottle.

2. The tubeless dispenser container of claim 1, wherein the inner bottle comprises:

a flange formed on an upper portion of the inner bottle; and a widened part formed to a particular height below the flange and having an outer diameter corresponding to an inner diameter of the outer bottle so as to tightly contact the inner perimeter of the outer bottle, wherein an inflow cavity open towards the bottom is formed in the widened part, and the one end of the upper channel is formed within the inflow cavity.

3. The tubeless dispenser container of claim 1, wherein the bottle part comprises an airduct protrusion, the airduct protrusion protruding upward in a particular length from the upper surface of the bottle part and forming a channel connecting with the air hole in an inside thereof, and the connector part comprises an insertion cavity, the insertion cavity configured to receive the airduct protrusion force-fitted therein such that the insertion cavity tightly contacts an outer perimeter of the airduct protrusion.

4. The tubeless dispenser container of claim 3, wherein, while the connector part is coupled to the upper portion of the bottle part, a bottom surface of the connector part is at least partially separated from the upper surface of the bottle part such that the content flowed out of the supply hole is supplied to the pump part through a space between the connector part and the bottle part.

5. The tubeless dispenser container of claim 1, wherein a recessed part is formed in the upper surface of the bottle part, the recessed part comprising a filling hole open towards the filling space, and the connector part has a portion thereof inserted in the recessed part to close the filling hole.

6. The tubeless dispenser container of claim 1, wherein the bottle part comprises a mounting rim, the mounting rim having an annular shape and protruding upward in a particular length from the upper surface of the bottle part, and the connector part is configured to have a portion thereof force-fitted into an inner side of the mounting rim so as to tightly contact an inner perimeter of the mounting rim.

7. The tubeless dispenser container of claim 6, wherein the connector part comprises an inner cap and a pump cap, the inner cap is configured to be force-fitted into the inner side of the mounting rim so as to tightly contact the inner perimeter of the mounting rim, and the pump cap is configured to be mounted onto an outer side of the mounting rim to tightly contact an outer perimeter of the mounting rim.

* * * * *